US009345266B2

(12) United States Patent
Black et al.

(10) Patent No.: US 9,345,266 B2
(45) Date of Patent: May 24, 2016

(54) APPARATUS AND METHOD FOR FORMING AND PACKAGING MOLDED TOBACCO

(71) Applicant: Philip Morris USA Inc., Richmond, VA (US)

(72) Inventors: Shannon Black, Richmond, VA (US); Andrew Nathan Carroll, Chester, VA (US); Tom Holland, Midlothian, VA (US)

(73) Assignee: PHILIP MORRIS USA INC., Richmond, VA (US)

( * ) Notice: Subject to any disclaimer, the term of this patent is extended or adjusted under 35 U.S.C. 154(b) by 10 days.

(21) Appl. No.: 14/269,901

(22) Filed: May 5, 2014

(65) Prior Publication Data

US 2014/0238420 A1 Aug. 28, 2014

Related U.S. Application Data

(62) Division of application No. 12/902,880, filed on Oct. 12, 2010, now Pat. No. 8,752,558.

(60) Provisional application No. 61/250,420, filed on Oct. 9, 2009.

(51) Int. Cl.

| | |
|---|---|
| ***A24B 1/10*** | (2006.01) |
| ***B65B 1/36*** | (2006.01) |
| ***B65B 1/38*** | (2006.01) |
| ***B65B 25/02*** | (2006.01) |
| ***B65B 63/02*** | (2006.01) |

(52) U.S. Cl.

CPC ... *A24B 1/10* (2013.01); *B65B 1/36* (2013.01); *B65B 1/38* (2013.01); *B65B 25/02* (2013.01); *B65B 63/02* (2013.01)

(58) Field of Classification Search

CPC ..... B65B 1/36; B65B 1/38; B65B 63/02; B65B 25/02; A24B 1/10; A22C 7/0084; A22C 7/00; A22C 7/0076

See application file for complete search history.

(56) References Cited

U.S. PATENT DOCUMENTS

| | | | |
|---|---|---|---|
| 111,800 | A | 2/1871 | Alms |
| 114,901 | A | 5/1871 | Alden |

(Continued)

FOREIGN PATENT DOCUMENTS

| | | | |
|---|---|---|---|
| DE | 26 55 036 | A1 | 6/1978 |
| WO | WO 2008/062301 | A1 | 5/2008 |

(Continued)

OTHER PUBLICATIONS

International Search Report and Written Opinion mailed Mar. 9, 2011 for International Search Report for PCT/EP2010/006192.

(Continued)

*Primary Examiner* — Michael H Wilson
*Assistant Examiner* — Dionne Walls Mayes
(74) *Attorney, Agent, or Firm* — Buchanan Ingersoll & Rooney PC

(57) ABSTRACT

An apparatus for molding and packaging molded tobacco pieces includes a mold having cavities oriented to allow ejection of molded tobacco pieces into a container. The apparatus also includes a knockout for ejecting the molded tobacco pieces, and a cutter having at least two blades for cutting the molded tobacco pieces into vertically aligned slices by passing one or more blades horizontally through the cavities.

14 Claims, 9 Drawing Sheets

(56) References Cited

U.S. PATENT DOCUMENTS

| | | | | | |
|---|---|---|---|---|---|
| 195,151 | A | | 9/1877 | Myers | |
| 9,172 | A | | 4/1880 | Clawson | |
| 245,759 | A | | 8/1881 | Wood | |
| 294,747 | A | | 3/1884 | Wright | |
| 336,801 | A | | 2/1886 | Evans et al. | |
| 584,241 | A | | 6/1897 | Richardson | |
| 683,951 | A | | 10/1901 | Lester | |
| 763,744 | A | | 6/1904 | Forsberg | |
| 940,803 | A | | 11/1909 | Hammond | |
| 990,532 | A | | 4/1911 | Fischer | |
| 1,078,492 | A | | 11/1913 | Fischer | |
| 1,099,114 | A | | 6/1914 | Bracy | |
| 1,154,914 | A | | 9/1915 | Dula | |
| 1,217,694 | A | | 2/1917 | Bracy | |
| 1,355,658 | A | | 10/1920 | Dula | |
| 1,690,895 | A | | 11/1928 | Fischer | |
| 2,322,175 | A | | 6/1943 | Talbot et al. | |
| 4,054,967 | A | * | 10/1977 | Sandberg | A22C 7/00 426/512 |
| 4,182,003 | A | * | 1/1980 | Lamartino | A22C 7/00 425/556 |
| 4,329,828 | A | * | 5/1982 | Wagner | A22C 7/00 426/513 |
| 4,597,135 | A | * | 7/1986 | Holly | A22C 7/0084 426/513 |
| 4,607,479 | A | | 8/1986 | Linden | |
| 4,733,803 | A | | 3/1988 | Sisson et al. | |
| 4,872,241 | A | * | 10/1989 | Lindee | A22C 7/00 425/573 |
| 4,975,039 | A | * | 12/1990 | Dare | A21C 5/02 425/238 |
| 5,173,361 | A | * | 12/1992 | Yamashita | F16G 1/12 152/526 |
| 5,655,436 | A | * | 8/1997 | Soper | A22C 7/00 425/556 |
| 7,051,771 | B2 | | 5/2006 | Ede et al. | |
| 8,151,802 | B2 | | 4/2012 | Boldrini | |
| 2002/0187229 | A1 | | 12/2002 | Fischer et al. | |
| 2003/0075055 | A1 | * | 4/2003 | Tournour | A22C 7/00 99/427 |
| 2007/0163605 | A1 | * | 7/2007 | Aeschlimann et al. | 131/77 |
| 2008/0202532 | A1 | | 8/2008 | Wygal | |

FOREIGN PATENT DOCUMENTS

| | | | |
|---|---|---|---|
| WO | WO 2008/062302 | A1 | 5/2008 |
| WO | WO 2010/112220 | A1 | 10/2010 |

OTHER PUBLICATIONS

International Preliminary Report on Patentability issued Apr. 11, 2012 for PCT/EP2010/006192.

Decision of Granting dated Oct. 15, 2014 for corresponding Russian Patent Appln. No. 2012118603.

* cited by examiner

APPARATUS AND METHOD FOR FORMING AND PACKAGING MOLDED TOBACCO

CROSS REFERENCE TO RELATED APPLICATION

This application is a divisional application of application Ser. No. 12/902,880, filed Oct. 12, 2010, entitled APPARATUS AND METHOD FOR FORMING AND PACKAGING MOLDED TOBACCO PIECES which claims priority under 35 U.S.C. §119(e) to U.S. Provisional Application No. 61/250,420, filed on Oct. 9, 2009, the entire content of each is incorporated herein by reference.

SUMMARY

Provided is a method of molding and packaging portioned tobacco products. The method comprises placing tobacco material in a mold having cavities oriented to allow ejection of molded tobacco pieces into a container, and ejecting the molded tobacco pieces from the cavities into a container. The method can further comprise extruding a tobacco dough into the cavities of the mold and/or pressing moist smokeless tobacco material into the cavities. The method can also include cutting the molded tobacco pieces into vertically aligned slices by passing one or more blades horizontally through the cavities. A knockout can be used to eject the molded pieces from the cavities. Preferably, the mold comprises cavities spaced far enough apart to avoid contact of the molded tobacco pieces during simultaneous ejection of the molded pieces from the cavities. The container comprises a cylindrical can and the molded tobacco pieces have substantially identical rectangular shapes, which are simultaneously ejected from the mold into the can after which a lid is placed on the can. Preferably, at least five molded tobacco pieces are molded and ejected simultaneously. The molded tobacco pieces have dimensions which permit a plurality of molded pieces, preferably six or more molded pieces to be simultaneously ejected into a single layer in the can.

In the preferred embodiment, the mold is formed of stainless steel and includes at least one group of cavities, preferably having at least five cavities. The cavities are preferably oriented such that: (a) end walls of one of the cavities are parallel to the side walls of another one of the cavities; (b) at least three of the cavities are aligned in one direction and two of the cavities are aligned in a different direction; (c) four of the cavities are aligned in one direction and one of the cavities is aligned in a direction perpendicular to the one direction; (d) one of the cavities has one end wall adjacent sidewalls of two of the cavities and the other end wall adjacent sidewalls of two other cavities; (e) four of the cavities are aligned in one direction and two other cavities are aligned in a direction perpendicular to the one direction; or (f) four of the cavities are side by side with end walls aligned and sidewalls parallel to each other.

Also provided is an apparatus for molding and packaging molded tobacco pieces. The apparatus comprises a mold having cavities oriented to allow ejection of molded tobacco pieces directly into a container. The mold is formed of a material selected from the group consisting of plastics, woods, metals and combinations thereof. Preferably, the mold is formed of stainless steel and includes at least one group of at least five cavities. The mold can include multiple partially connected layers, each layer having multiple vertically aligned cavities. Preferably, the mold includes a back plate. The cavities include sidewalls defined by openings in a mold plate and a bottom wall defined by the back plate. The cavities are preferably rectangular in shape with shorter end walls and longer sidewalls with dimensions which permit a plurality (preferably six or more) molded pieces to be simultaneously ejected into the can. The cavities are oriented, preferably such that: (a) end walls of one of the cavities are parallel to the side walls of another one of the cavities; (b) at least three of the cavities are aligned in one direction and two of the cavities are aligned in a different direction; (c) four of the cavities are aligned in one direction and one of the cavities is aligned in a direction perpendicular to the one direction; (d) one of the cavities has one end wall adjacent sidewalls of two of the cavities and the other end wall adjacent sidewalls of two other cavities; (e) four of the cavities are aligned in one direction and two other cavities are aligned in a direction perpendicular to the one direction; or (f) four of the cavities are side by side with end walls aligned and sidewalls parallel to each other. Preferably, the cavities are spaced far enough apart to avoid contact of the molded tobacco pieces during simultaneous ejection of the molded pieces from the cavities into the can. In an embodiment, the mold can be coated with plastic.

In the preferred embodiment, the apparatus can include a knockout for ejecting the molded tobacco pieces from the cavities when the mold plate is moved to a position such that the back plate no longer blocks bottom openings in the mold plate so as to allow molded pieces to pass through the mold plate. In addition, the apparatus can include a cutter having at least two blades for cutting the molded tobacco pieces into vertically aligned slices by passing one or more blades horizontally through the cavities.

DETAILED DESCRIPTION

Provided is a method and apparatus for molding tobacco material to form molded tobacco pieces and packaging the molded tobacco pieces. The method and apparatus described herein reduces complexities of manufacturing packaged, molded tobacco pieces (moist snuff) by configuring groups of cavities of a mold plate in accordance with a final, desired package orientations (configuration) and ejecting the orientated groups of molded tobacco pieces directly into containers. Preferably, the molded tobacco pieces have dimensions which permit a plurality, preferably about six molded pieces or more to be simultaneously ejected into each can. Thus, upon ejection of the molded tobacco pieces from the mold, the pieces are automatically deposited into the container in a preferred orientation without the need for additional manipulation and adjustments.

Preferably, the molded tobacco pieces are smokeless tobacco products, such as moist smokeless tobacco products. The moist smokeless tobacco products can include tobacco and at least one additive.

Examples of suitable types of tobacco materials that may be used include, but are not limited to, flue-cured tobacco, air-cured, dark fired tobacco, Burley tobacco, Maryland tobacco, Oriental tobacco, rare tobacco, specialty tobacco, reconstituted tobacco, agglomerated tobacco fines, blends thereof and the like. Preferably, the tobacco material is fermented. In an alternative embodiment, some or all of the tobacco material may be pasteurized.

The tobacco material may be provided in any suitable form, including shreds and/or particles of tobacco lamina, processed tobacco materials, such as volume expanded or puffed tobacco, or ground tobacco, processed tobacco stems, such as cut-rolled or cut-puffed stems, reconstituted tobacco materials, blends thereof, and the like. Genetically modified tobacco may also be used.

Additionally, the tobacco material may also include a supplemental amount of vegetable or plant fibers or particles, such as particles of shreds of lettuce, cotton, flax, beet fiber, cellulosic fibers, blends thereof and the like.

Preferably, the tobacco material comprises moist smokeless tobacco having a moisture content of about 35% to about 65%. The tobacco material comprises moist smokeless tobacco having a water activity of about 0.85 aw to about 0.87 aw.

The additives are selected from the group consisting of binders, polymers, water, flavorants, colorants, humectants, preservatives, nutraceuticals, antioxidants, vitamins, minerals, and combinations thereof.

The moist smokeless tobacco products can be sticky to the touch. The tobacco material can be pressed and/or extruded into the mold plate, as described herein, to form molded tobacco pieces. Preferably, the tobacco products as molded herein are sized to be placed in a user's mouth.

Figure 1:
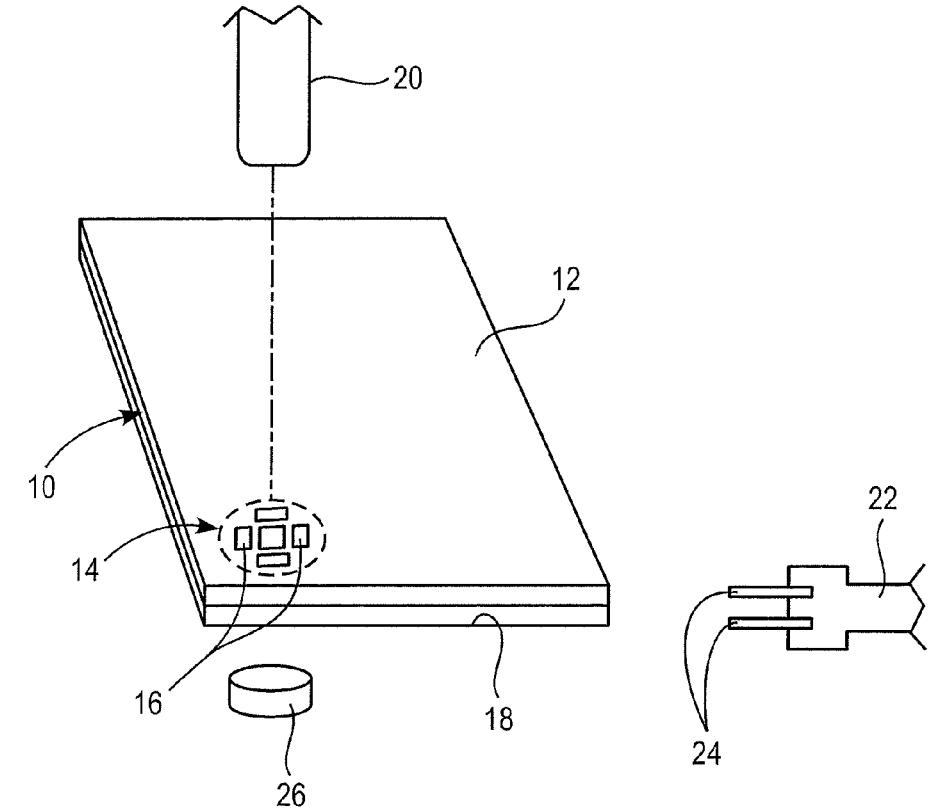
FIG. 1 is an illustration of an apparatus including a mold with cavities for molding and packaging molded tobacco pieces.
Figure 17:
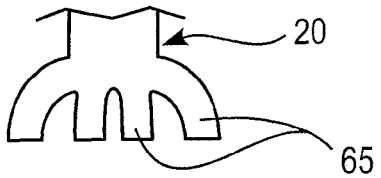
FIG. 17 is an illustration of a knockout having projections.

As shown in FIG. 1, the apparatus 10 for molding and packaging tobacco includes a mold plate 12. The mold plate 12 can include one or more groups 14 of cavities 16 and at least one back plate 18. The cavities 16 include sidewalls defined by openings in the mold plate and a bottom wall defined by the back plate 18. In a preferred embodiment, moist smokeless tobacco material can be pressed into the cavities 16 of the mold plate 12. Alternatively, a tobacco dough is extruded into the cavities 16 of the mold plate 12. Once the tobacco material is molded, the mold plate 12 is moved forward so that the back plate 18 no longer underlies the mold plate 12, and the molded tobacco pieces are allowed to pass through the mold plate 12. Preferably, a knockout 20 is used to force the molded tobacco pieces from the cavities 16 directly into a lidless container 26. In an alternative embodiment, the back plate 18 can be a movable back plate 18, which moves after molding and prior to ejection to as to allow the molded tobacco pieces to pass through the mold plate 12. The knockout 20 is used because the molded tobacco material can be sticky, and thus difficult to remove from the mold plate 12. In a preferred embodiment, the knockout 20 can include multiple projections 65 (shown in FIG. 17) configured to mate with the cavities 16 of the mold plate 12. To facilitate release of molded tobacco pieces, the walls defining each mold cavity may be slightly inclined (at or about 3 degrees) such that the cavities are slightly more open in the direction of ejection of the molded pieces.

Figure 14:
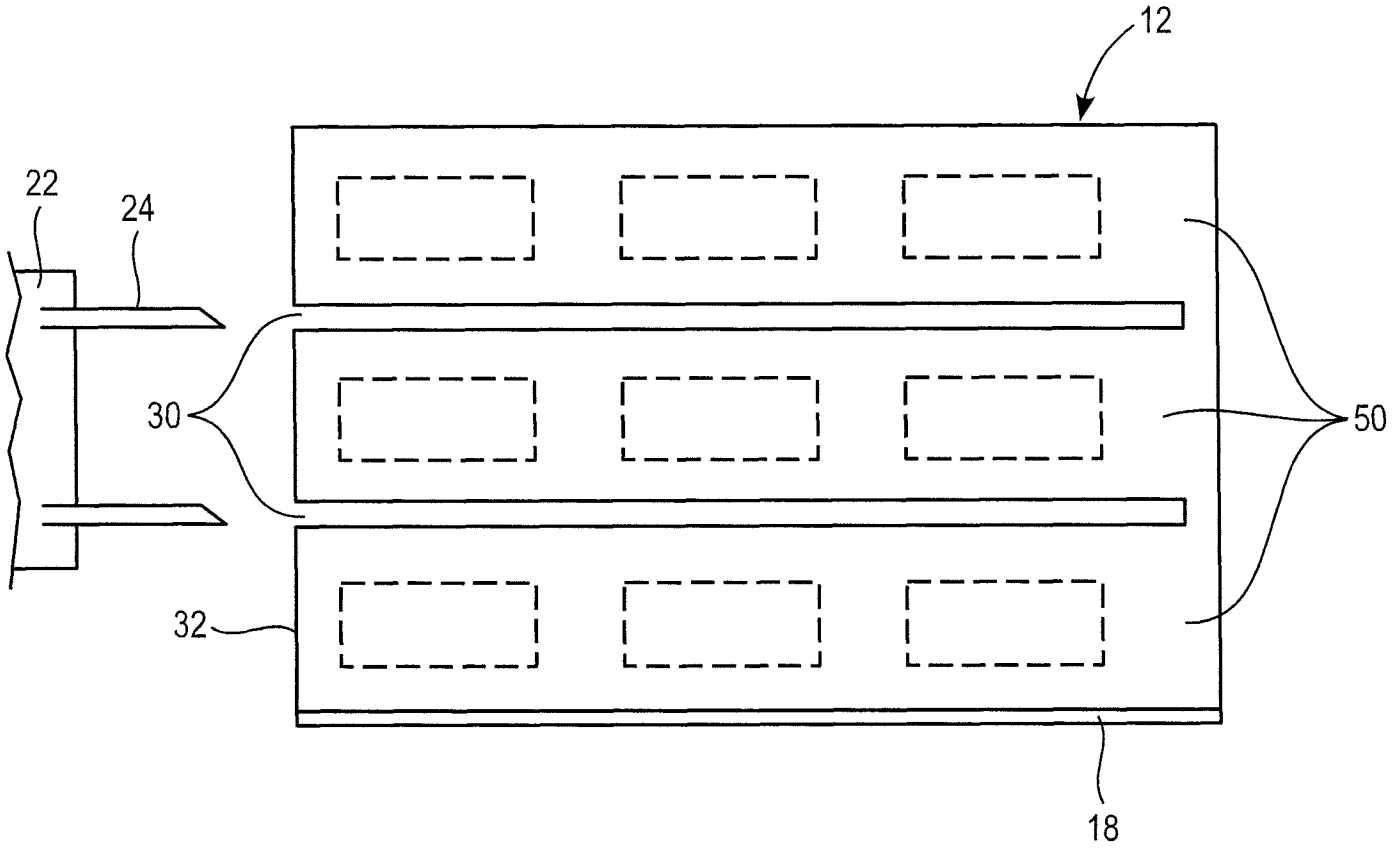
FIG. 14 is a side view of the mold having multiple partially connected layers.

In an embodiment, the mold includes a mold plate 12 including multiple layers 50 (as shown in FIG. 14), and the apparatus can include a cutter 22. Preferably, the cutter 22 includes at least two blades 24 (e.g., at least three blades, at least four blades or at least five blades), and is operable to cut the molded tobacco pieces into vertically aligned slices by passing the one or more blades 24 horizontally through slits 30 in sidewalls 32 (also shown in FIG. 14) of the cavities 16. In a preferred embodiment, each layer 50 includes at least three cavities 16 for forming at least three molded tobacco pieces per layer 50. Preferably, the cavities 16 of each layer are vertically aligned so that the tobacco material passes through the upper cavity to the lower cavities during molding. Once the molded tobacco pieces are sliced, the blades of the cutter 22 are withdrawn and the multiple layers of molded tobacco pieces are ejected from the cavities 16 and into a container 26.

In a preferred embodiment, the mold plate 12 can be formed of a material selected from the group consisting of plastics, metals, woods, and combinations thereof. Suitable plastics include, without limitation, polypropylene, polyethylene, and the like. Preferably, the plastics are high density plastics. When formed of plastic, the mold plate 12 can be injection molded. Suitable metals include without limitation, stainless steel, aluminum and the like. In the preferred embodiment, the mold plate 12 is formed of stainless steel. Metal mold plates are preferred because of the stress put on the plate during molding and ejecting of the molded materials.

In an embodiment, metal mold plates can optionally include a coating material which aids in easy removal of the molded tobacco pieces, which can be sticky, from the cavities 16 of the mold plate 12. Suitable coatings include polymer coatings, such as Teflon®, Silverstone® and the like. The coatings applied to metals, such as stainless steel, aid in forming high wear metal mold plates.

The mold plate 12 can be about 18 inches to about 20 inches long. In a preferred embodiment, the mold plate 12 is about 18.5 inches in length. Also in the preferred embodiment, the mold plate 12 includes at least about two groups 14 of cavities 16, preferably at least about three groups 14, more preferably at least about four groups 14, even more preferably at least about five groups 14, and most preferably at least about six groups 14 of cavities 16.

In a preferred embodiment, the mold plate 12 includes multiple groups 14 of cavities 16. Also preferably, each group 14 includes at least two cavities 16, more preferably at least three cavities 16, and most preferably at least four cavities 16

(e.g., at least five cavities or at least six cavities or more). By including multiple cavities 16, multiple molded tobacco pieces can be formed simultaneously and ejected as a group into a container 26, such as a can.

Preferably, each group 14 of cavities 16 within the mold plate 12 has a diameter of about 2.0 inch to about 3.0 inch, more preferably about 2.25 inch to about 2.5 inch. In the preferred embodiment, the diameter of the group 14 is substantially the same as the diameter of the container 26 into which the molded tobacco pieces are to be injected.

Preferably, each cavity 16 is sized and configured to form a molded tobacco piece that can be placed in a user's mouth. Thus, in a preferred embodiment, each cavity 16 and each resulting molded tobacco piece is about 1.0 inch to about 1.5 inch in length (e.g., about 1.0 to about 1.25 inch or about 1.1 to about 1.5 inch in length), and about 0.25 inch to about 1.0 inch in width (e.g., about 0.30 to about 0.9 inch in width). In addition, each cavity 16 has a depth of about 0.2 inch to about 0.5 inch in depth, more preferably about 0.2 inch to about 0.3 inch in depth. The height of each molded tobacco piece is about 0.2 inch to about 0.5 inch, more preferably about 0.2 inch to about 0.3 inch. Thus, each cavity 16 produces a molded tobacco piece having a volume of about 0.05 cubic inches to about 1.05 cubic inches.

Preferably, the molded tobacco pieces are placed in a container 26, such as a can, having an inner diameter of about 2.25 inches to about 2.75 inches, more preferably about 2.4 inches to about 2.5 inches. Also preferably, the can has an inner depth of about 0.6 inch to about 0.8 inch. In the preferred embodiment, the can has an inner depth of about 0.7 inch. Preferably, one or more layers of molded tobacco pieces can be arranged within the can such that the combined height of the layers of molded tobacco pieces is less than the inner depth of the can so as to avoid compression of the molded tobacco pieces within the can to avoid sticking together of the molded tobacco pieces within the can. Once the molded tobacco pieces have been injected into the can, a lid can be placed on the can and the can may be sealed.

In the preferred embodiment, the geometry of the containers is such that the molded tobacco pieces will not fit therein unless arranged in a specified manner. Also preferably, the molded tobacco pieces have dimensions which permit a preselected number of pieces, preferably six, seven, eight pieces or more to be simultaneously ejected into the container in a specific arrangement in a single layer. However, the container can be designed to hold multiple layers of molded tobacco pieces, each layer containing a plurality of molded pieces, preferably about six, seven, eight pieces or more which are simultaneously ejected into the container. Thus, the apparatus eliminates the need for additional manipulation of the molded tobacco pieces prior to sealing the container.

The cavities 16 and/or molded tobacco pieces can be formed in any shape or size. Suitable shapes include, without limitation, rectangles, squares, oblong shapes, circles, ovals, stars, leaf shapes, moon shapes, crescents, combinations thereof and the like. In some embodiments, larger and/or smaller cavities and/or molded tobacco pieces can be included in a single group to form molded tobacco pieces having a variety of sizes, which can be deposited in a single can to produce a can of molded tobacco pieces offering a variety of serving sizes. Regardless of the shape of the cavity and the resulting molded tobacco pieces, the cavities must be arranged, and thus ejected in a specific configuration so that the molded tobacco pieces will fit in the container without additional manipulation of the molded tobacco pieces. The molded tobacco pieces can be uniform in size or vary in size within a single container.

Figure 2:
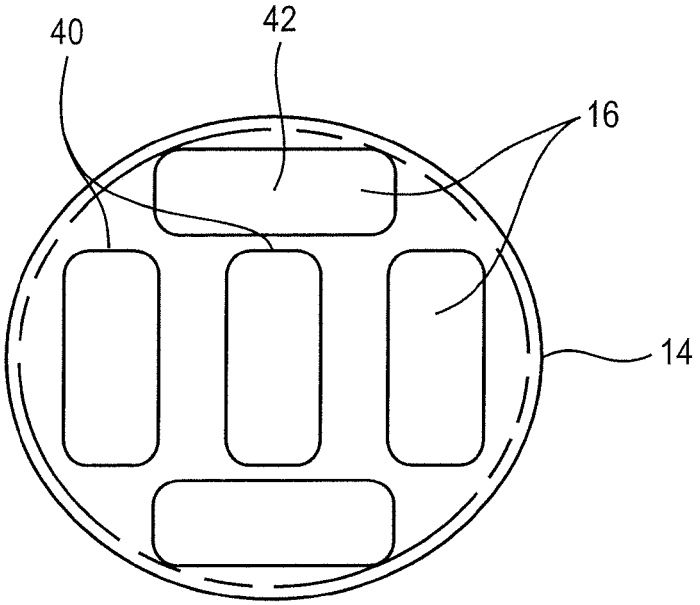
FIG. 2 is a top view of a first group of cavities within the mold.

FIG. 2 is an illustration of a first configuration of a group 14 of cavities 16. Preferably, the cavities 16 are oriented such that the molded tobacco pieces can be ejected directly into a container 26 (shown in FIG. 1) without the need for additional manipulation of the molded tobacco pieces. As shown, the cavities 16 are substantially rectangular with rounded corners. End walls 40 of one of the cavities 16 are parallel to the side walls 42 of another one of the cavities 16. Preferably, as shown, at least three of the cavities 16 are aligned with their long axes in one direction and two of the cavities 16 are aligned with their long axes in a different direction.

Preferably, the width of the end walls 40 and the width of the side walls 42 of the cavities 16 is large enough to prevent collapse of the cavities 16 during filling and molding and to prevent the tobacco material placed in the cavities 16 from sticking together during filling, molding and ejecting. Preferably, the end walls 40 and side walls 42 of the cavities are at least about 0.080 inches to about 0.200 inches in thickness, more preferably about 0.082 inches to about 0.150 inches in thickness.

Figure 3:
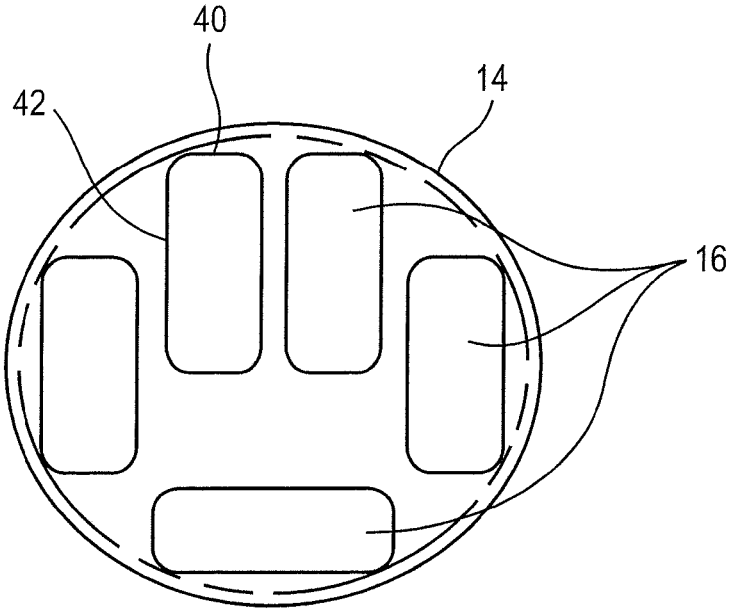
FIG. 3 is a top view of a second group of cavities within the mold.

As shown in FIG. 3, in a second group 14, the cavities 16 having a substantially rectangular shape with rounded corners are aligned with the long axes of four cavities in one direction and the long axis of one of the cavities 16 aligned in a direction perpendicular to the one direction.

Figure 4:
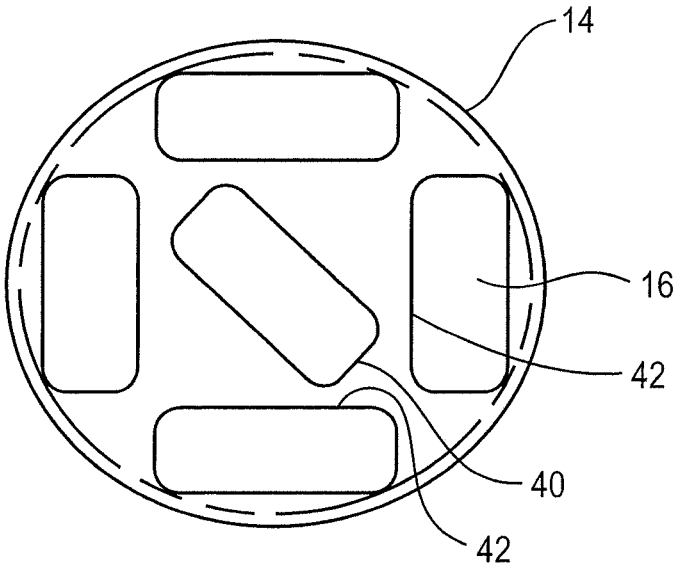
FIG. 4 is a top view of a third group of cavities within the mold.

FIG. 4 shows a third group 14 of rectangular cavities 16 wherein one of the cavities 16 has one end wall 40 adjacent sidewalls 42 of two of the cavities 16 and the other end wall 40 adjacent sidewalls 42 of two other cavities 16.

Figure 5:
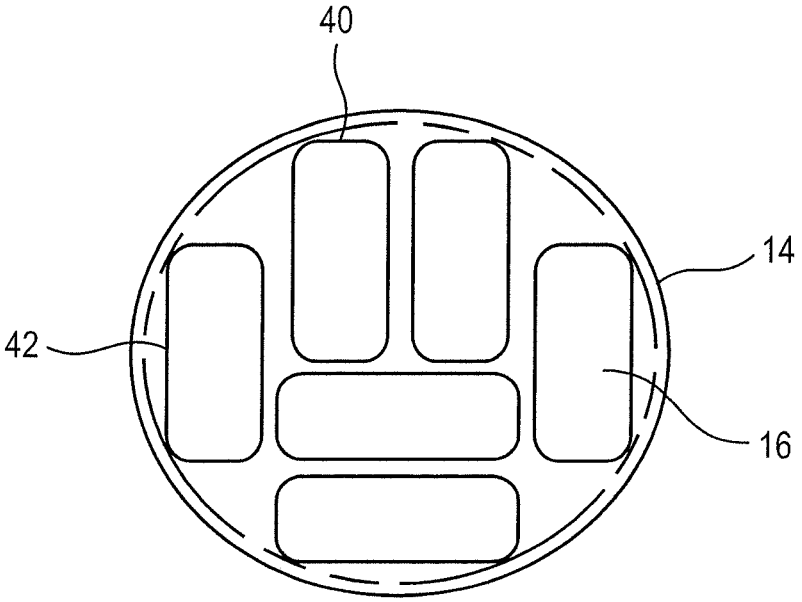
FIG. 5 is a top view of a fourth group of cavities within the mold.

In a fourth group 14, shown in FIG. 5, the long axes of four of the cavities 16 are aligned in one direction and the long axes of two other cavities 16 are aligned in a direction perpendicular to the one direction.

Figure 6:
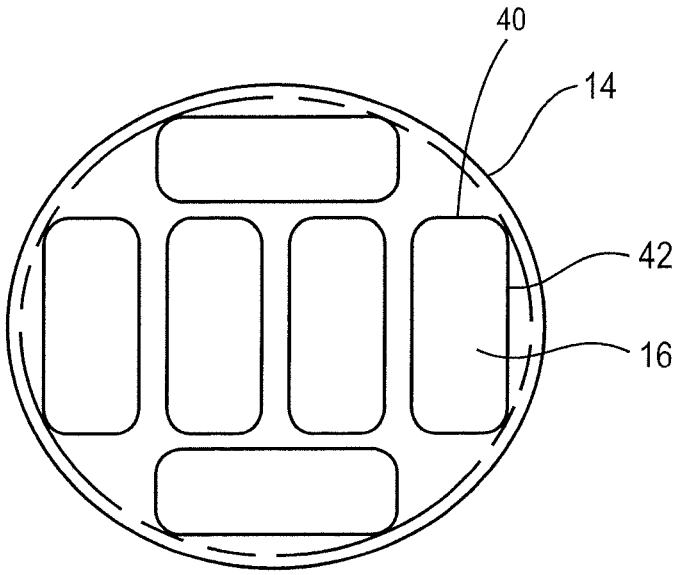
FIG. 6 is a top view of a fifth group of cavities within the mold.

As shown in FIG. 6, in a fifth group 14, four of the cavities 16 are side by side with end walls 40 aligned and sidewalls 42 parallel to each other. Two other cavities are arranged with their long axes perpendicular to the long axes of the four side by side cavities 16.

Figure 7:
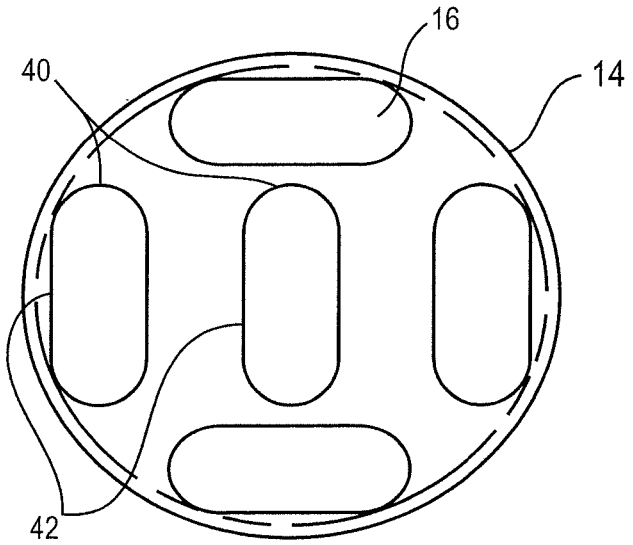
FIG. 7 is a top view of a sixth group of cavities within the mold.

As shown in FIG. 7, the cavities 16 have sidewalls 42 that are substantially rectilinear and end walls 40 that are substantially semicircular. End walls 40 of one of the cavities 16 are adjacent to the side walls 42 of the other cavities 16. Preferably, as shown, at least three of the cavities 16 are aligned in one direction and two of the cavities 16 are aligned in a different direction perpendicular to the three cavities 16.

Figure 8:
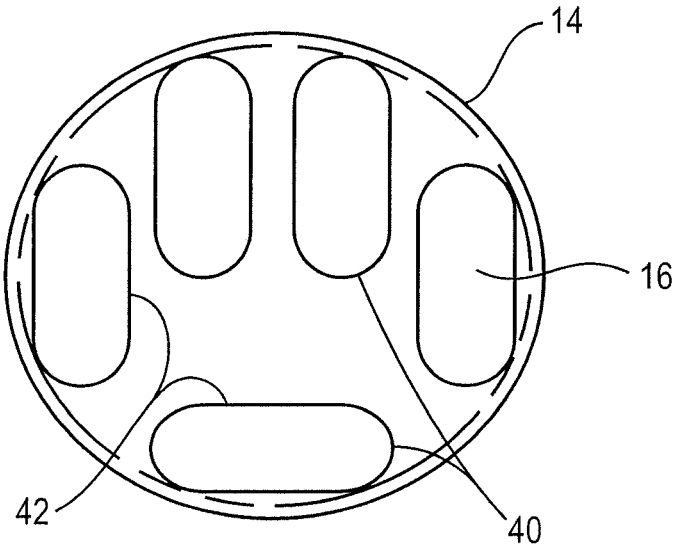
FIG. 8 is a top view of a seventh group of cavities within the mold.

FIG. 8 shows a group 14 wherein cavities 16 having a substantially oblong shape are aligned with the long axes of four cavities 16 in one direction and the long axis of one of the cavities 16 is aligned in a direction perpendicular to the one direction.

Figure 9:
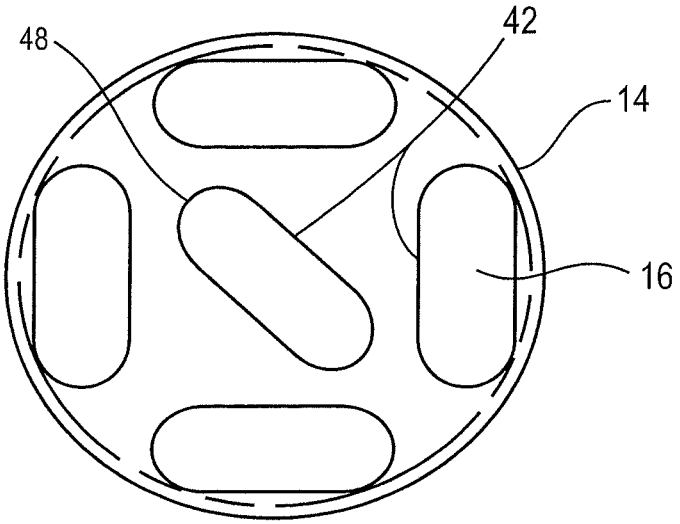
FIG. 9 is a top view of an eighth group of cavities within the mold.

FIG. 9 shows a group wherein the cavities 16 are oblong, one of the cavities 16 has one end wall 40 adjacent sidewalls 42 of two of the cavities 16, and the other end wall 40 adjacent sidewalls 42 of two other cavities 16.

Figure 10:
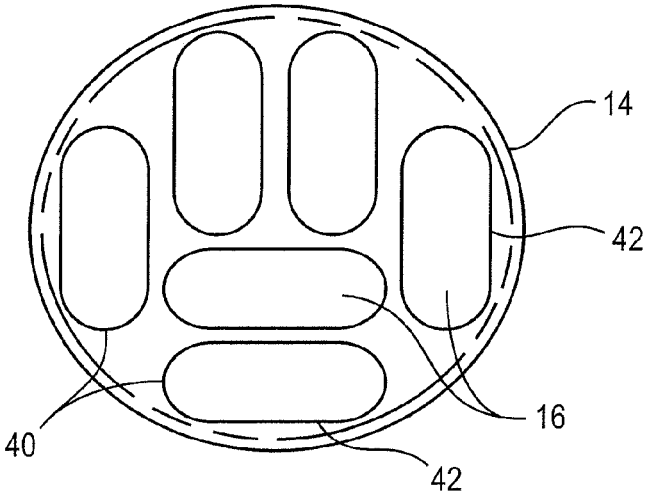
FIG. 10 is a top view of a ninth group of cavities within the mold.

FIG. 10 illustrates a group 14 in which the long axes of four of the oblong cavities 16 are aligned in one direction and the long axes of two other oblong cavities 16 are aligned in a direction perpendicular to the one direction.

Figure 11:
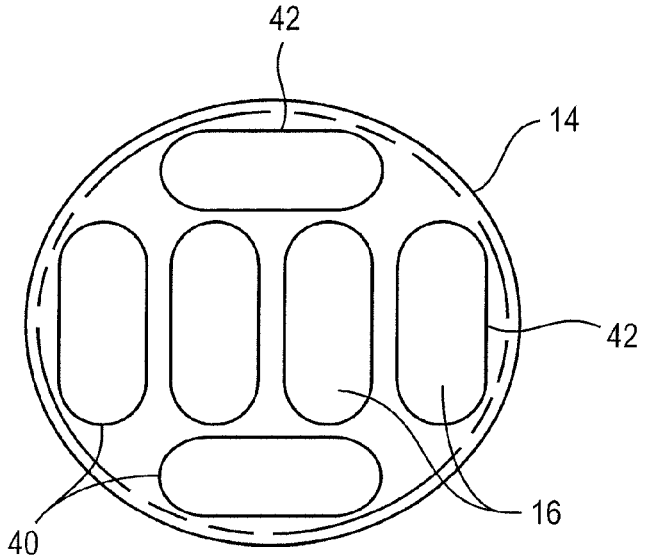
FIG. 11 is a top view of a tenth group of cavities within the mold.

FIG. 11 shows a group 14 in which four of the cavities 16 are side by side with end walls 40 between sidewalls of two other cavities. Two other oblong cavities are arranged with their long axes perpendicular to the long axes of the four side by side cavities.

Figure 12:
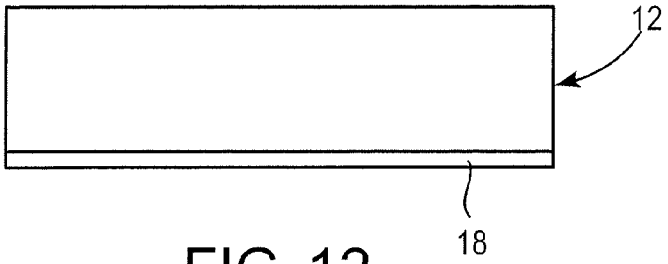
FIG. 12 is a side view of the mold having a single layer and a bottom plate.

A side view of the mold plate 12 is shown in FIG. 12. The mold plate 12 includes a back plate 18. The back plate 18 can be movable or stationary in relation to the mold plate 12. In use, the back plate 18 completely underlies the cavities 16 during filling of the cavities. After filling the cavities, the mold plate 12 is moved in order to eject the molded tobacco pieces therefrom. In other embodiments, after filling the cavities, the back plate 18 is moved in order to eject the molded tobacco pieces from the mold plate 12. Once the molded tobacco pieces have been ejected from the cavities 16, the mold plate 12 can be repositioned overtop the back plate 18.

If the back plate 18 is a movable back plate 18, the movable back plate 18 can slide into and out of position. Alternatively, the back plate 18 can be hingedly connected to the mold plate 12 or the back plate 18 can be swivellable with relation to the mold plate 12.

If the mold plate 12 is movable and the back plate 18 is stationary, the mold plate 12 can slide into and out of position.

Figure 13:
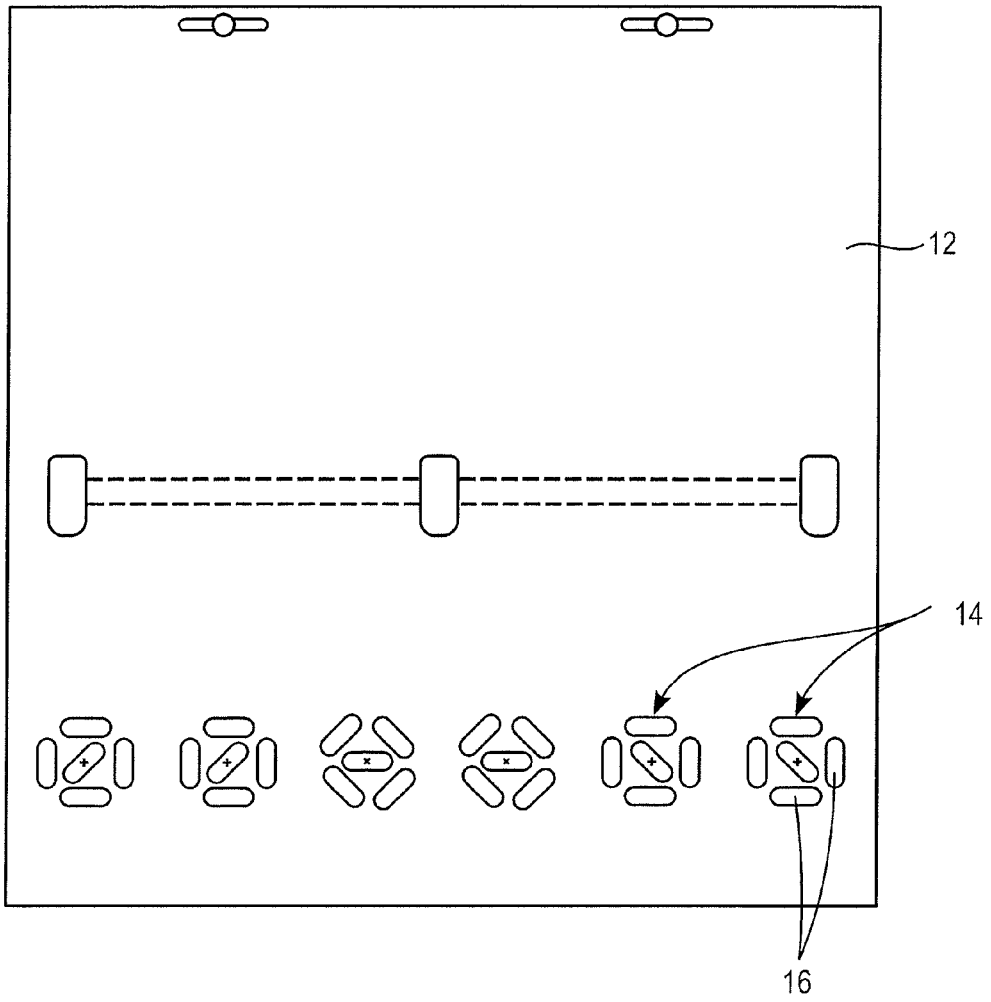
FIG. 13 is an illustration of the mold plate having multiple cavity groups therein.

As shown in FIG. 13, to allow simultaneous filling of cans, a single mold plate 12 can include multiple groups 14 of cavities 16. Thus, a single mold plate 12 can be used to mold tobacco products and package the molded tobacco products into several containers per mold. Preferably, the mold plate 12 includes six groups 14. Each group 14 can have the same configuration of cavities 16. Alternatively, each group 14 can have a different configuration of cavities 16. Preferably, the center of a first group 14 is about 3.25 inches away from the center of a second group 14 on the mold plate 12 when the groups 14 are arranged side by side thereon.

FIG. 14 is a side view of a mold plate 12 having multiple layers 50 with vertically aligned cavities 16 that are at least partially connected. Thin slits 30 in the side wall 32 separate the layers 50 of the mold plate. Once the tobacco products have been molded, blades 24 of a cutter 22 enter the slits 30 between the layers 50 and cut the molded tobacco pieces into vertically aligned slices.

The mold plates 12 can be used in conjunction with a conveyor system. Containers can pass beneath and in proximity to the mold plates 12 as the molded tobacco pieces are ejected from the mold plates 12, such that the molded tobacco pieces fall into the container. A single mold having multiple groups 14 of cavities 16 can be used to form layers of molded tobacco pieces in an offset and/or aligned arrangement within a single container. Alternatively, a single mold having multiple groups 14 of cavities 16 can fill a row of containers.

Figure 15:
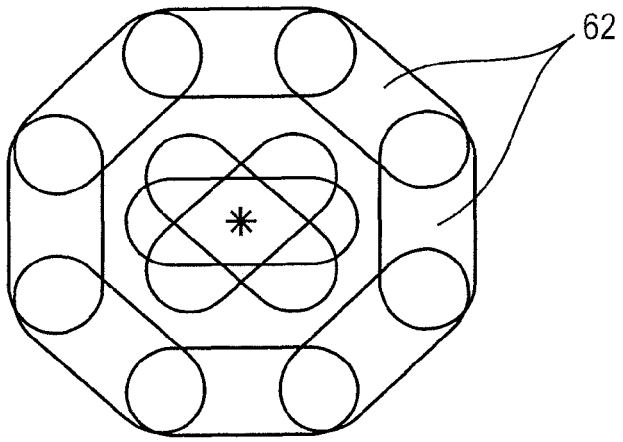
FIG. 15 is an illustration of the orientation of three layers of molded tobacco pieces after ejection from the mold plate into a container.

FIG. 15 is a top view of an arrangement of three layers of molded tobacco pieces in a can. Such an arrangement can be formed by having mold plates 12 with varying groups 14 arranged on a conveyor system. A first mold plate 12 having a first group 14 of cavities 16 can be used to mold a first layer of molded pieces and deposit the first layer in a container. A second mold plate 12 having a second group 14 of cavities 16 can be used to mold a second layer of molded pieces and deposit the second layer on top of the first layer in the container. Finally, a third mold plate 12 having a third group 14 of cavities 16 can be used to mold a third layer of molded pieces and deposit the third layer on top of the second layer in the container.

In other embodiments, the layers of molded tobacco pieces are aligned within the can. Such an arrangement can be formed using a mold plate 12 having multiple layers 50 (shown in FIG. 14) or a mold plate 12 having multiple groups 14 of cavities 16 (shown in FIG. 13), each group 14 having the same configuration.

Figure 16:
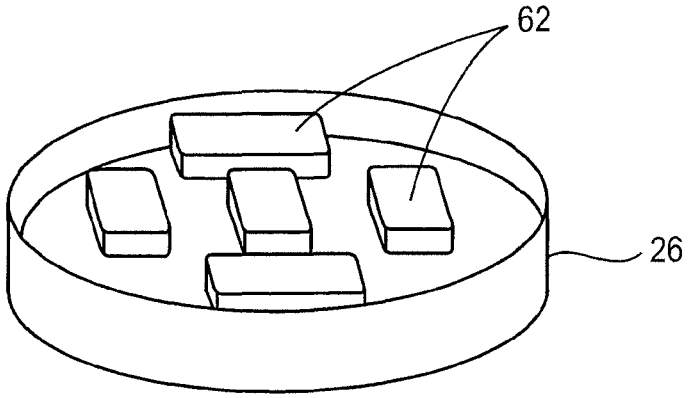
FIG. 16 is an illustration of a single layer of molded tobacco pieces arranged in a container after ejection from the first group of cavities as shown in FIG. 2.

FIG. 16 is an illustration of molded tobacco pieces 62 placed in a cylindrical container 26. The container 26 can have a diameter of about 2.0 inches to about 3.0 inches. Other containers including, without limitation, square, and rectangular containers can also be used.

Preferably, the cavities 16 of the mold plate 12 are oriented such that the molded tobacco pieces 62 can be ejected directly into the container 26 without need for arrangement and/or manipulation of the molded tobacco pieces 62 prior to sealing the container 26. As shown, each layer of molded tobacco pieces 62 can be offset from the other layers. In other embodiments, layers of the molded tobacco pieces 62 can be vertically aligned within the container.

In this specification, the word "about" is often used in connection with a numerical value to indicate that mathematical precision of such value is not intended. Accordingly, it is intended that where "about" is used with a numerical value, a tolerance of 10% is contemplated for that numerical value.

Moreover, when the words "generally" and "substantially" are used in connection with geometric shapes, it is intended that precision of the geometric shape is not required but that latitude for the shape is within the scope of the disclosure. When used with geometric terms, the words "generally" and "substantially" are intended to encompass not only features which meet the strict definitions but also features which fairly approximate the strict definitions.

While the foregoing describes in detail an apparatus and method for molding and packaging molded tobacco pieces, it will be apparent to one skilled in the art that various changes and modifications may be made to the disclosed apparatus and methods and further that equivalents may be employed, which do not materially depart from the spirit and scope of the invention. Accordingly, all such changes, modifications, and equivalents that fall within the spirit and scope of the invention as defined by the appended claims are intended to be encompassed thereby.

We claim:

1. An apparatus for packaging molded tobacco pieces, comprising:

a mold having cavities oriented to allow ejection of molded tobacco pieces directly into a container, the cavities having sidewalls defined by openings in a mold plate and a bottom wall defined by a back plate;

a knockout operable to eject the molded tobacco pieces from the cavities into the container when either the mold plate or the back plate is moved to a position allowing the molded pieces to pass through the mold plate; and wherein said mold plate includes multiple partially connected layers, which are separated by slits, and wherein the cavities in each layer are vertically aligned with cavities in other layers.

2. The apparatus of claim 1, wherein said mold is formed of a material selected from the group consisting of plastics, woods, metals and combinations thereof.

3. The apparatus of claim 1, wherein the mold is formed of stainless steel and includes a group of cavities of a predetermined number and in a desired orientation.

4. The apparatus of claim 1, wherein the mold plate is movable from a fill position closing bottoms of the cavities to an eject position at which the bottoms are open.

5. The apparatus of claim 1, wherein the cavities are rectangular in shape with shorter end walls and longer sidewalls with dimensions which permit a predetermined number of molded pieces to be simultaneously ejected into the container, the cavities oriented such that: (a) end walls of one of the cavities are parallel to the side walls of another one of the cavities; (b) at least three of the cavities are aligned in one direction and two of the cavities are aligned in a different direction; (c) four of the cavities are aligned in one direction and one of the cavities is aligned in a direction perpendicular to the one direction; (d) one of the cavities has one end wall adjacent sidewalls of two of the cavities and the other end wall adjacent sidewalls of two other cavities; (e) four of the cavities are aligned in one direction and two other cavities are aligned in a direction perpendicular to the one direction; or (f) four of the cavities are side by side with end walls aligned and sidewalls parallel to each other.

6. The apparatus of claim 1, wherein the cavities are spaced far enough apart to avoid contact of the molded tobacco pieces during simultaneous ejection from the cavities.

7. The apparatus of claim 1, wherein the mold further includes a coating on the sidewalls and/or bottom wall of the cavities.

8. The apparatus of claim 7, wherein the coating comprises plastic.

9. The apparatus of claim 1, wherein the container is cylindrical with a diameter of about 2.25 to about 2.75 inches, and a depth of about 0.6 to about 0.8 inch.

10. The apparatus of claim 1, wherein the mold plate is movable from a position at which the back plate is beneath the cavities to a position at which the molded tobacco pieces can be ejected into the container.

11. The apparatus of claim 1, wherein the back plate is movable from a position at which the back plate is beneath the cavities to a position at which the molded tobacco pieces can be ejected into the container.

12. The apparatus of claim 1, further comprising a conveyor system transporting containers beneath the mold plate.

13. An apparatus for packaging molded tobacco pieces, comprising:

a mold having cavities oriented to allow ejection of molded tobacco pieces directly into a container, the cavities having sidewalls defined by openings in a mold plate and a bottom wall defined by a back plate;

a knockout operable to eject the molded tobacco pieces from the cavities into the container when the mold plate is moved to a position allowing the molded pieces to pass through the mold plate; and a cutter having at least two blades configured to cut the molded tobacco pieces into vertically aligned slices by passing the blades horizontally through the cavities.

14. An apparatus for packaging molded tobacco pieces, comprising:

a mold having cavities oriented to allow ejection of molded tobacco pieces directly into a container, the cavities having sidewalls defined by openings in a mold plate and a bottom wall defined by a back plate;

a knockout operable to eject the molded tobacco pieces from the cavities into the container when the mold plate is moved to a position allowing the molded pieces to pass through the mold plate; and wherein the mold plate is arranged to deposit a first layer of molded tobacco pieces in the container, a second mold plate is arranged to deposit a second layer of molded tobacco pieces on the first layer and a third mold plate is arranged to deposit a third layer of molded tobacco pieces on the second layer in the container.

* * * * *